United States Patent [19]

Buschemeyer

[11] Patent Number: 4,772,148

[45] Date of Patent: Sep. 20, 1988

[54] LIQUID APPLICATOR

[76] Inventor: Sallie Q. Buschemeyer, 254 Ridgeway Corner, Louisville, Ky. 40207

[21] Appl. No.: 868,583

[22] Filed: May 30, 1986

[51] Int. Cl.[4] ..... A47L 13/17

[52] U.S. Cl. ..... 401/206; 401/264; 401/273

[58] Field of Search ..... 401/206, 264, 262, 269, 401/278, 273

[56] References Cited

U.S. PATENT DOCUMENTS

| | | | |
|---|---|---|---|
| 2,543,195 | 2/1951 | Petion | 401/206 |
| 3,129,452 | 4/1964 | Schwartzman | 401/206 |
| 3,135,988 | 6/1964 | Schwartzman | 401/206 |
| 3,203,026 | 8/1965 | Schwartzman | 401/206 |
| 3,256,551 | 6/1966 | Schwartzman | 401/206 |
| 3,565,294 | 2/1971 | Schwartzman | 401/206 |
| 3,601,287 | 8/1971 | Schwartzman | 401/206 |
| 3,663,113 | 5/1972 | Frain et al. | 401/206 |
| 4,043,681 | 8/1977 | Funahashi | 401/206 |
| 4,461,408 | 7/1984 | Shepard | 401/264 |
| 4,569,612 | 2/1986 | Schwartzman et al. | 401/206 |

*Primary Examiner*—Dave W. Arola
*Attorney, Agent, or Firm*—Jon C. Winger

[57] ABSTRACT

A liquid applicator includes a generally cylindrical container having an open neck end. A flexible bag adapted to hold a liquid to be applied is disposed within the container with the open mouth of the bag located within the open neck of the container. A valve assembly is situated in the open neck of the container to control the flow of liquid from the bag. A dauber tip of porous material having its exterior surface coated with flock is located over the valve assembly at the exterior of the open container neck for receiving liquid flowing through the valve assembly and applying the liquid to an object.

7 Claims, 2 Drawing Sheets

LIQUID APPLICATOR

BACKGROUND OF THE INVENTION

The present invention relates to liquid applicators, and more particularly to a liquid applicator wherein the flow of liquid therefrom is controlled by a valve and having a dauber tip covered with flock, providing capillaries to uniformly apply the liquid.

Various liquid applicators having a valve for controlling liquid flow are known. By way of example, some of the heretofore known valve controlled applicators are shown in U.S. Pat. Nos. 3,135,988; 3,192,533; 3,256,551; 3,349,966; 3,481,294; 3,545,874; 3,565,294; and 3,661,468.

It is an object of the present invention to provide a liquid applicator adapted to smoothly apply a liquid to an object even when the applicator is held at an acute angle to the object.

It is another object of the present invention to provide a liquid applicator which is spill proof.

It is yet another object of the present invention to provide a liquid applicator having a flock covered convex dauber tip for uniformly applying the liquid to an object.

It is still another object of the present invention to provide a liquid applicator which facilitates easy assembly of the various components thereof.

BRIEF DESCRIPTION OF THE DRAWINGS

The various objectives and features of the present invention will become even more clear upon reference to the following discussion in conjunction with the accompanying drawings wherein like numerals refer to like parts throughout the several figures and in which.

DESCRIPTION OF THE PREFERRED EMBODIMENT

Figure 1:
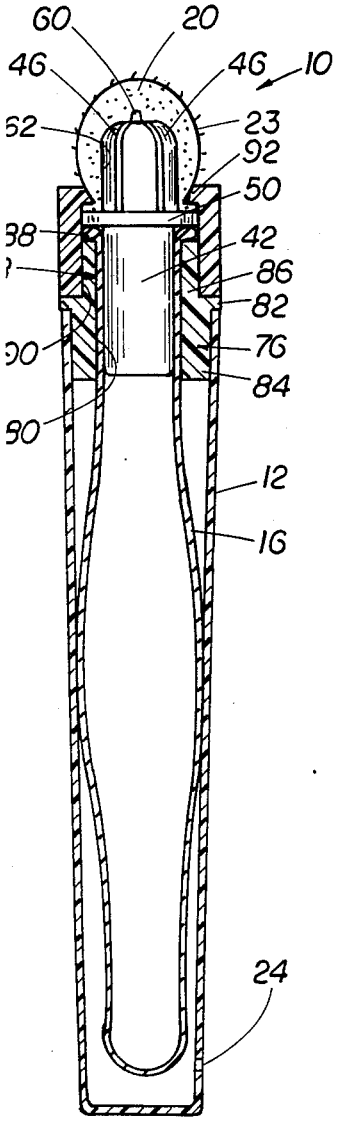
FIG. 1 is a longitudinal cross-sectional view of a liquid applicator including the features of the present invention.

With reference to FIG. 1, there is shown a liquid applicator, generally denoted as the numeral 10. The applicator 10 includes a generally cylindrically shaped hollow container 12 having one open neck end 14, and enclosing a bladder or bag 16. The applicator 10 further includes a valve assembly 18 located in the open neck end 14 of the container in liquid flow communication with the interior of the bag 16. A porous dauber tip 20 is disposed over the end of the valve assembly 18 at the open neck end 14 of the container 12. The porous tip 20 is selectively covered by a removable cap 22 having a circumferential bottom edge defining the bottom open end of the cap 22.

The bag 16 is fabricated of a flexible material, for example, a rubber, or plastic such as polyethylene, or the like. The body of the bag 16 is sized and configured to substantially fill the hollow interior of the container 12. The bag 16 is adapted to be the reservoir for the liquid to be applied by the liquid applicator 10. In order to prevent a vacuum from being created within the container 12 which could prevent or inhibit the flow of liquid from the bag 16 through the open bag mouth, a ventilation aperture 24 is formed through a wall of the container 12 so that the interior of the container 12 surrounding the bag 16 is an atmospheric pressure.

Now with reference to FIGS. 1, 2, 8, 9, 10 and 11, the valve assembly 18 comprises a valve housing, generally denoted as the numeral 36, enclosing a valve 38, and a valve spring 40. The valve housing 36 includes a depending barrel 42, and a plurality flexible fingers 44 spaced apart in a circular array about and extending upwardly from the top marginal edge of the depending barrel 42. The fingers 44 converge toward their distal ends 46 forming cylindrical basket-like structure approximating the contour of the dauber tip 20. Further, the convergent distal ends of the fingers 44 define an opening 47 coaxial with the depending barrel 42. An inwardly projecting circumferential flange 48, and an outwardly projecting circumferential flange 50 are located on the barrel 42 near the proximal ends of the fingers 44. The inwardly projecting flange 48 defines a central valve stem aperture 52 coaxial with the opening 47 at the distal ends 46 of the fingers 44. The inwardly projecting flange 48 includes a circular lip 54 coaxial with the opening 47 at the distal ends 46 of the fingers 44. The inwardly projecting flange 48 includes a circular lip 54 coaxial with the valve stem aperture 52 and extending downwardly from the bottom side of the inwardly projecting flange 48 toward, and coaxial with, the valve housing depending barrel 42. The circular lip 54 defines a valve seat. The outwardly projecting circumferential flange 50 forms an anchoring flange for the skirt 21 of the dauber tip 20. The upper surface of the outwardly projecting flange 50 is formed with a plurality of spaced apart holes 56 in a circular array about the flange 50 which function to further secure the tip 20 in place.

With reference to FIGS. 1, 2 and 9, 10 and 11, the valve 38 comprises a generally circular valve head 58 and an integrally formed valve stem 60 projecting coaxially from the top side of the valve head 58. The valve head 58 is of larger diameter than the diameter of the valve seat lip 54, and its perimeter is formed with serrations which provide selected liquid flow through paths for the liquid. The valve lip 54 is adapted to sealingly contact the top side of valve head 58 radially inwardly of the serrations. In addition, the bottom side of the valve head 58 is formed with a small centrally located pivot cavity 61. As shown, the cavity 61 is generally conically shaped. The valve stem 60 is longer than the distance between the valve stem aperture 52 and the opening 47, formed at the distal ends of the fingers 44, measured coaxially of the valve stem aperture 52 and opening 47. The valve 38 is positioned within the valve housing 36 with the top side of the valve head 58 positioned adjacent the bottom side of the valve seat lip 54 and the valve stem 60 projecting upwardly through the valve stem aperture 52 of the upwardly projecting circumferential flange 48 and through the opening 47 at the distal ends 46 of the fingers 44 to project outwardly beyond the distal ends 46 of the fingers 44.

Figure 11:
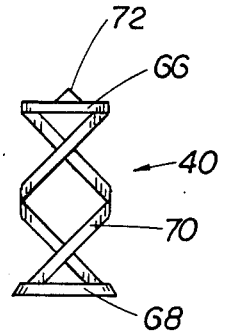
FIG. 11 is a side view of a further component of the valve assembly of FIG. 2.
Figure 9:
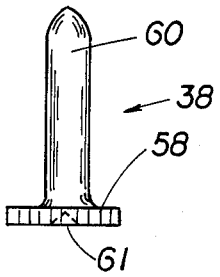
FIG. 9 is a side view of antoher component of the valve assembly of FIG. 2.

With reference to FIG. 1 and 11, the dauber tip 20 is fabricated of a porous material, for example, polypropylene or polyurethane. The entire exterior surface of the dauber tip 20 is covered with flocking 23. Virtually any type of material can be used as the flock, for example, wool, cotton, silk or rayon fiber. The tip 20 is coaxially located over the basket-like structure defined by the fingers 44 and the outwardly projecting circumferential flange 50. The outer contour of the tip 20 is convex, and preferably has a rather sharp pointed contour such as a bullet. The tip 20 is formed with a concentric blind ended pocket 62 open to the bottom side of the tip 20. The pocket 62 generally conforms in shape and size to the basket-like structure of fingers 44. The pocket 62 receives the basket-like structure of the fingers 44 so that the dauber tip 20 is coaxial with the valve stem aperture 52 of the flange 48, and the pocket 62 is open to the valve stem aperture 52. The end of the valve stem 60 projecting beyond the distal ends 46 of the fingers 44 of the valve housing 36 is embedded into the porous dauber tip material at the blind end of the pocket 62. The outside diameter of the dauber tip skirt 21 at the open end of the pocket 62 is approximately equal to the diameter of the outwardly projecting flange 50 of the valve housing 18. The bottom end of the dauber skirt 21 surrounding the opening of the pocket 62 is in contact with the flange 50.

Figure 12:
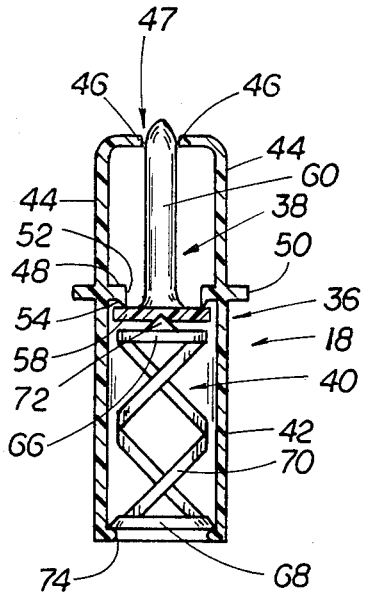
FIG. 12 is a cross-sectional view of the valve assembly of FIG. 2.
Figure 10:
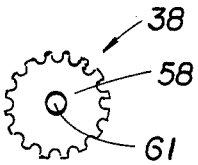
FIG. 10 is a bottom view of the component of FIG. 9.

With reference to FIGS. 11 and 12, the valve spring 40 is shown as comprising a valve head contact plate 66 at one end, a valve spring retainer ring 68 at the other end, and at least one helical coil 70 integrally formed at its opposite end with the contact plate 66 and retainer ring 68, respectively. The valve head contact plate 66 is generally circular in shape and is of a smaller diameter than the valve head 58. Further, the valve head contact plate 66 has a pivot point structure 72 projecting upwardly from and coaxial with the top side of the head contact plate 66. The pivot point structure 72 is sized and configured to fit into the pivot cavity 61 in the bottom side of the valve head 58. The pivot point structure 72 and pivot cavity 61 cooperate to define pivot means allowing the valve 38 to pivot with respect to the valve spring 40. The valve spring 40 is located concentrically within the depending barrel 42 of the valve housing 36 with the valve head contact plate 66 adjacent the bottom side of the valve head 58 and the pivot point 72 located in the pivot cavity 61. The valve spring 40 is retained in the depending barrel 42, under compression, by the bottom swaged end 74 of the depending barrel 42 in contact with the valve spring retainer ring 68. Therefore, the helical coil 70 biases the valve head contact plate 66 against the valve head 58 which forces the valve head 58 in sealing contact with the valve seat lip 54 of the valve seat flange 48 closino the valve stem aperture 52 preventing liquid from flowing from the bag 16 into the void pocket 62 of the tip 20. An advantageous benefit of the seal between the valve head 58 and valve seat lip 54 is that the dauber tip 20 can be rinsed with water without contaminating the liquid in the bag 16.

Figure 4:
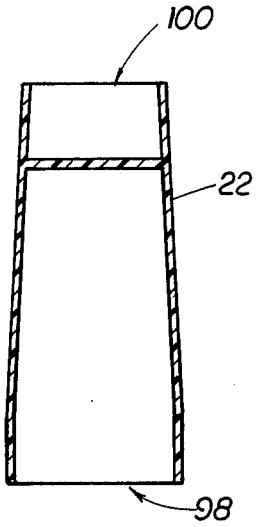
FIG. 4 is a cross-sectional side view of a further component of the applicator of FIG. 1.
Figure 4:
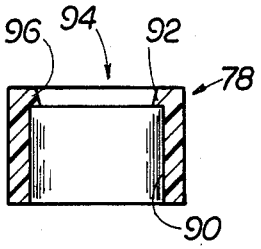
Figure 6:
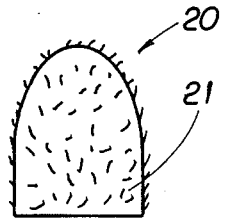
FIG. 6 is a side view of the dauber tip of the applicator of FIG. 1.
Figure 7:
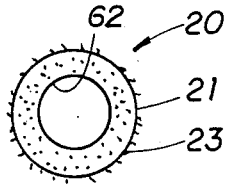
FIG. 7 is a bottom view of the dauber tip of FIG. 6.
Figure 3:
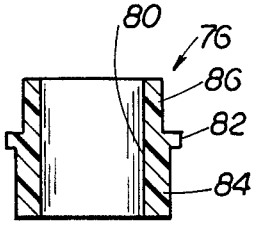
FIG. 3 is a cross-sectional side view of another component of the applicator of FIG. 1.
Figure 5:
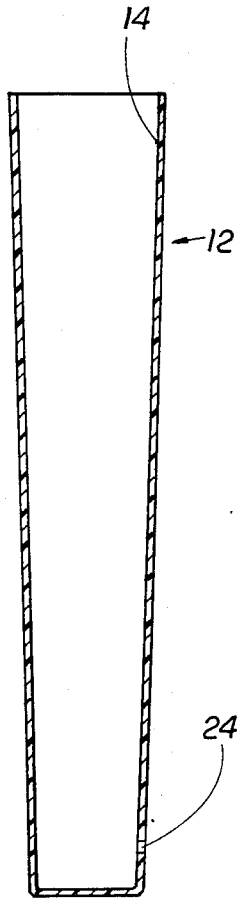
FIG. 5 is a cross-sectional side view of a further component of the appliciator of FIG. 1.
Figure 2:
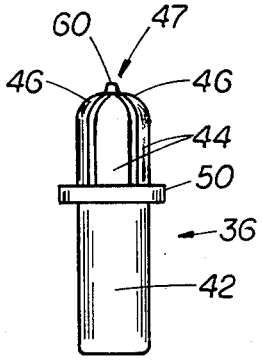
FIG. 2 is a longitudinal view of a valve assembly of the applicator of FIG. 1.
Figure 8:
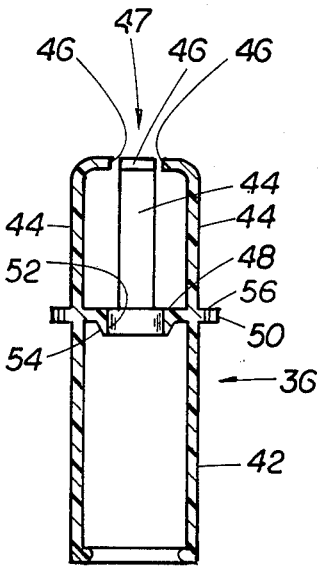
FIG. 8 is a longitudinal cross-sectional view of a component of the valve assembly of FIG. 2.

Now with reference to FIGS. 1, 3 and 4, the valve assembly 18 and bladder 16 are held in position in the open neck 14 of the container 12 by means of cooperating plug 76 and collar 78.

With reference to FIGS. 1 and 3, the plug 76 is cylindrical in configuration having a concentric through bore 80. The bore 80 is sized to concentrically receive the barrel 42 of the valve housing 36 as can be seen in FIG. 1. The plug 76 includes circumferential flange 82 extending outwardly from the exterior surface of the plug 76. The diameter of the circumferential flange 76 is about the same as the outside diameter of the container 12. The lower cylindrical portion 84 of the plug 76 extending beneath the flange 82 has an outside diameter substantially equal to the inside diameter of the hollow interior of the container 12. The upper cylindrical portion 86 of the plug 76 extending above the flange 82 has an outside diameter smaller than the outside diameter of the lower cylindrical portion 84. When the plug 76 is in place in the container 12, the lower cylindrical portion 84 is concentrically received in the interior of the container, the flange 76 overlays the circumferential edge of the container 12 defining the open container neck 14, and the upper cylindrical portion 86 projects coaxially outwardly from the container neck 14.

With reference to FIG. 1, the open mouth of the bag 16 is sized and configured to smoothly fit over the barrel 42 of the valve housing 36 with the margin of the bag mouth adjacent the outwardly projecting circumferential flange 50. The portion of the wall of the bag 16 fitted over the valve housing barrel 42 is tightly captured between the exterior surface of the valve housing barrel 42 and the surface of the bore 80 of the plug 76 providing a liquid tight seal therebetween. In addition, the margin of the bag 16 defining the bag mouth is sealingly captured between the free circumferential edge of the upper cylindrical portion 86 of the plug 76 and the underside of the outwardly projecting circumferential flange 50 of the valve housing 36. To enhance the sealing effect, as shown in FIG. 1, the bag 16 can be formed with an O-ring seal 88 surrounding the bag mouth. The O-ring seal 88 is coaxial with the barrel 42 of the valve housing 36 and is in sealing abutment with the bottom surface of the outwardly projecting circumferential flange 50 of the valve housing 36.

With reference to FIGS. 1 and 4, the collar 78 has a concentric central bore 90 having a diameter approximately equal to the diameter of the upper cylindrical portion 86 of the plug 76 and the diameter of the outwardly projecting flange 50 of the valve housing 36. The outside diameter of the collar 78 is approximately equal to the diameter of the circumferential flange 82 of the plug 76. The top end of the collar 78 includes a circumferential flange 92 projecting inwardly of the bore 90. The circumferential flange 92 defines a central aperture 94 coaxial with the bore 92. The aperture 94 has a larger diameter than the circular basket-like structure formed by the fingers 44 of the valve housing 36 but a smaller diameter than the diameter of the outwardly projecting circumferential flange 50 of the valve housing 36. The circumferential edge 96 of the circumferential flange 92 is chamfered away from the aperture 94.

When the collar 78 is in place, the central bore 90 concentrically receives the outwardly projecting flange 50 of the valve housing 36 and the upper cylindrical portion 86 of the plug 76, with the porous dauber tip 20 extending through the central aperture 94. The circumferential flange 92 circumferentially overlaps a portion of the outwardly projecting circumferential flange 50 compressing the dauber tip material therebetween to secure the dauber tip 20 in place on the basket-like structure of fingers 44. Portions of the compressed dauber tip material are also, thusly, forced into the holes 56 in the flange 50 of the valve housing 36 to further secure the dauber tip 20 from rotational movement. The chamfered circumferential edge 96 of the circumferential flange 92 provides a diverging annular gap between the circumferential edge 96 of the flange 92 and the wall of the dauber tip 20 so that the wall of the porous dauber tip 20 can smoothly expand from the captured skirt 21 to the portion of the dauber tip 20 extending through the central aperture 94 of the collar 78. The dauber tip 20 may also be adhesively attached to the fingers 44 if desired to further secure the tip 20 in place.

The cap 22 is formed with a first pocket 98 for receiving the extending dauber tip 20 and sealing about the periphery of the container 12, thus protecting the dauber tip 20 when the applicator 10 is stored. The cap 22 further includes a second control pocket 100 opposite the first pocket 98 for receiving the bottom end 102 when the applicator 10 is in use.

In use, after the cap 22 has been removed from its position over the tip 20, the dauber tip 20 is placed against an object upon which the liquid is to be applied with enough force to even slightly compress the tip 20. The compression of the tip 20 causes the blind end of the pocket 62 to pivot or rock the stem 60 of the valve 38 about the pivot point 72 of the valve head contact plate 66, thus, moving a portion of the valve head 58 away from the valve seat lip 54 against the biasing force of the valve spring 40. When this occurs, liquid is allowed to flow from the bag 16 past the portion of the serrated peripheral edge of the valve head 58 lifted from the sealing lip 54, and into the porous dauber tip 20. The liquid passes through the porous tip material to the flocking 23 on the outer surface of the tip 20 whereat the liquid is applied to the object. The flocking 23 provides a capillary action which results in a uniform coating of liquid over the exterior surface of the dauber tip 20 so that a smooth uniform coating of liquid is applied to the object. When the tip 20 is removed from the object to which the liquid has been applied, the resilient fingers 44, in conjunction with the force exerted by the valve spring 40, moves the valve stem 60 back to center within the void 62 about the pivot point 72, and the helical coil 70 forces the valve head 58 back into total contact with the valve seat lip 54.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A liquid applicator comprising:

(a) a container having an open neck at one end;

(b) a valve assembly for controlling liquid flow located within the container neck comprising an outwardly projecting circumferential flange;

(c) a bag for containing a liquid to be applied located within the container, the open mouth of the bag being secured to the valve assembly;

(d) a porous dauber tip defining a blind-ended pocket receiving a portion of the valve assembly;

(e) the dauber skirt bordering the opening into the blind-ended pocket of the dauber tip circumferentially abuts the outwardly projecting circumferential flange of the valve assembly;

(f) collar means encircling the perimeter of the skirt of the dauber tip and cooperating with the outwardly projecting circumferential flange of the valve assembly to compressively capture the skirt of the dauber tip therebetween securing the dauber tip to the valve assembly; and (g) the dauber tip having an exterior surface covered with flocking.

2. The applicator of claim 1, wherein the dauber tip is secured to the outside surface of the valve assembly.

3. The liquid applicator of claim 1, wherein:

(a) the valve assembly comprises a valve housing comprising a plurality of flexible fingers, the distal ends of the fingers converging; and, (b) the porous material of the dauber tip defines a blend-ended pocket receiving the flexible fingers of the valve assembly.

4. The liquid applicator of claim 3, wherein:

(a) said outwardly projecting circumferential flange is near the proximal ends of the fingers.

5. The liquid applicator of claim 4, wherein the outwardly projecting flange of the valve assembly is formed with holes into which the material of the dauber tip skirt is forced by the collar.

6. The liquid applicator of claim 4, wherein the collar comprises an inwardly projecting circumferential flange defining a central aperture smaller in diameter than the diameter of the outwardly projecting circumferential flange of the valve housing receiving the dauber tip therethrough radially compressing the skirt of the dauber tip and circumferentially overlapping a portion of the outwardly projecting circumferential flange of the valve housing compressively capturing the skirt of the dauber tip therebetween.

7. The liquid applicator of claim 6, wherein the circumferential edge of the inwardly projecting flange of the collar is chamfered away from the central aperture thereof to define a diverging annular gap between the wall of the dauber tip extending through the central aperture and the circumferential edge of the inwardly projecting flange.

* * * * *